US006389246B1

(12) United States Patent
Nakamura et al.

(10) Patent No.: US 6,389,246 B1
(45) Date of Patent: May 14, 2002

(54) COLOR IMAGE FORMING APPARATUS

(75) Inventors: Masae Nakamura; Takashi Yamamoto, both of Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/766,658

(22) Filed: Jan. 23, 2001

(30) Foreign Application Priority Data

Jul. 6, 2000 (JP) ..... 2000-205281

(51) Int. Cl.[7] ..... G03G 15/16
(52) U.S. Cl. ..... 399/66; 430/110
(58) Field of Search ..... 399/66, 27, 297, 399/298, 299, 303, 312; 430/110

(56) References Cited

FOREIGN PATENT DOCUMENTS

| | | |
|---|---|---|
| JP | 6-83151 | 3/1994 |
| JP | 9-319179 | 12/1997 |
| JP | 11-102112 | 4/1999 |

*Primary Examiner*—Arthur T. Grimley
*Assistant Examiner*—Hoang Ngo
(74) *Attorney, Agent, or Firm*—Armstrong, Westerman & Hattori, LLP

(57) ABSTRACT

Disclosed is a color image forming apparatus in which a color image is formed by accumulating a visible image on an image transfer medium. The color image forming apparatus includes a plurality of forming means for forming the visible image on an image forming medium with a toner; and a plurality of transferring means for transfer the visible image onto the image transfer medium while bringing the visible image into contact with the image transfer medium. With respect to a toner amount which is transferred from each of the image forming medium onto the image transfer medium, difference between a toner deposition amount on the image transfer medium right after transferring the visible image from the image forming medium and a final toner deposition amount on the image transfer medium in the event of transfer of visible images is completed onto the image transfer medium is set such that the difference of the toner deposition amount of the visible image which is transferred by the transferring means disposed on an upstream side is larger than that on a downstream side in a direction where the visible image is successively formed.

5 Claims, 5 Drawing Sheets

COLOR IMAGE FORMING APPARATUS

BACKGROUND OF THE INVENTION

1. Field of the Invention

The present invention generally relates to an image forming apparatus, more particular, to the image forming apparatus provided with an image forming unit for forming a single color toner image onto an image transfer medium, such as a paper, wherein a toner image of full colors is formed by accumulating the single color toner image.

2. Description of the Related Art

There are many methods for forming a color image on an image transfer medium, such as a paper. For example, an image forming apparatus for the color image based on electrophotography comprises a photoconductor as an image forming medium and an intermediate transfer body, namely a single photoconductor drum type apparatus. As another example, there is known a tandem type apparatus in which a plurality of image forming unit are arranged in succession.

The single photoconductor drum type apparatus comprises four color developing bodies for three colors (yellow, magenta and cyan) and black for the purpose of formation of color images on a periphery of the single photoconductor drum. This apparatus employs a technology in which one color toner image is formed on the photoconductor drum by means of each developing body and is then transferred onto the intermediate transfer body sequentially, and the foregoing steps are repeated to form full color toner images thereon which are in turn transferred onto a recording material. On the other hand, the tandem type apparatus comprises four image forming units for three colors and black in order for each unit to form the single toner image. This apparatus is based on a technology that a single color toner image is successively accumulated on a paper or the like which is arranged in a transporting direction, thereby producing the color images.

In any types of the color image forming apparatus described above, the single color toner image is successively transferred and then accumulated so as to form the color image. When toner image is transferred, a subsequent toner image is accumulated on the previous toner image except that a yellow toner image is transferred. Thus, because of repetition of such a transfer step, a toner image which was previously formed on the paper or the like may adhere to other photoconductor drum (which is a photoconductor drum on a downstream side) in a subsequent transfer step. That is to say, there may be arisen problems that a reverse transfer phenomenon takes place.

Under these circumstances, it is proposed an image forming apparatus in which an improvement is made for a decrease in a toner deposition amount on the paper due to the reverse transfer phenomenon. For example, it is proposed a control method of the toner deposition amount on the paper, wherein a developing roll in a developing unit has a surface roughness different from that of other developing roll, as disclosed in Japanese Laid-Open Patent Application No. 11-102112. However, in this case, there may exist a need for preparation of the developing rolls dedicated to each of the developing unit, so that manufacturing cost is increased and it is required to have much time and costs for apparatus maintenance.

Japanese Laid-Open Patent Application No. 6-83151 describes a control method of the toner deposition amount on the paper, by which a latent image strength on the photoconductor drum or development bias of the developing unit is controlled. However, in this case, it is necessary to establish bias conditions for each color. This cases the apparatus to be manufactured more expensively due to complexity of control content.

Japanese Laid-Open Patent Application No. 9-319179 describes a control method of the toner deposition amount on the paper, wherein a toner particle size is controlled. The method is based on the fact that the toner deposition amount is increased with increase in a particle size, so that the particle size can varies with colors. However, in this case, there may be possibility of image quality difference according to colors. The toner particle size constitutes a causative factor in image quality. If the toner particle size is large, image quality is likely to degrade. In a case of the color toner where the deposition amount is accurately controlled by increasing the toner particle size, since uniformity of a deposition amount onto the paper as a whole is likely to be irregular, it is difficult to produce images with acceptable quality.

In addition, Japanese Laid-Open Patent Application No. 9-319179 also describes a control method of the toner deposition amount on the paper, wherein toner fluidity is controlled. However, in this case, problems are encountered in image quality on account of difference of the toner fluidity between the colors. When the toner fluidity is poor, there may be possibility of solidification of the toners due to a strong aggregation force between the toners. This results in degradation of image quality with the contour of the image being deformed, as observed in the case of using the large toner particle size, thereby providing problems relating to defective appearance of the image.

As described above, although there has been proposed many technologies in order to eliminate the problems caused by the reverse transfer phenomenon, another problems occurs with high cost for manufacturing the image forming apparatus, complexity of the apparatus and degradation of image quality. The problems due to the reverse transfer phenomenon can not be completely solved at the present stage.

SUMMARY OF THE INVENTION

Accordingly, it is a general object of the present invention is to provide a color image forming apparatus wherein the aforementioned problems are eliminated.

A more specific object of the present invention is to provide the color image forming apparatus wherein the problems due to the reverse transfer phenomenon can be resolved by simple constructions and with good manufacturing cost.

The above objects of the present invention are achieved by a color image forming apparatus in which a color image is formed by accumulating a visible image on an image transfer medium, comprising:

- a plurality of forming means for forming the visible image on an image forming medium with a toner; and
- a plurality of transferring means for transfer the visible image onto the image transfer medium while bringing the visible image into contact with the image transfer medium, wherein with respect to a toner amount which is transferred from each of the image forming medium onto the image transfer medium, difference between a toner deposition amount on the image transfer medium right after transferring the visible image from the image forming medium and a final toner deposition amount on the image transfer medium in the event of transfer of visible images is completed onto the image transfer medium is set such that the difference of the toner deposition amount of the visible image which is transferred by the transferring means disposed on an upstream side is larger than that on a downstream side in a direction where the visible image is successively formed.

The image transfer medium is a member for carrying the toner until a powder-like single color toner image is successively accumulated while transporting the plurality of transfer parts, so as to form a final full color toner image. For example, the intermediate transfer body corresponds to the above image transfer medium in the case of the image forming apparatus based on the single drum type. On the other hand, a sheet-like recording material such as a paper and a film or the like corresponds to the above image transfer medium in the case of the image forming apparatus based on the tandem type.

According to one aspect of the present invention, the toner image is formed with the largest deposition amount on the image transfer medium by means of the transferring means on the most upstream side. The toner deposition amount decreases in a downstream direction. After formation of the toner image on the image transfer medium, the toner deposition amount is changed according to the rotation number of the reverse transfer of respective toner image, so that an appropriate image density can be expressed.

According to other aspect of the present invention, since a decrease amount of the toner deposition of the toner image formed on the upstream side through the reverse transfer phenomenon is simply defined each time the toner image passes through one transferring means, the image forming apparatus can be realized with the simple construction.

The above objects of the present invention are also achieved by a color image forming apparatus provided with an unit for forming an image, in which a color image is formed by accumulating a visible image on an image transfer medium, the unit comprising:

a plurality of supplying means for supplying various types of toners;

at least one forming means for forming the visible image on an image forming medium with the toner; and transferring means for transfer the visible image onto the image transfer medium while bringing the visible image into contact with the image transfer medium, wherein each of the toner which is stored in the respective supplying means includes an external additive and an addition amount, which is given by Sn, of the external additive contained in the respective supplying means is set such that there is an relationship of $S1<S2<S3<S4 \ldots >Sn$, when n represents the order from an upstream side.

According to further another aspect of the present invention, a function of increasing the toner deposition amount can be enhanced onto the image forming medium by increasing the addition amount of the external additive into the toner for use in the image forming means on the upstream side. Therefore, by the provision of the simple construction that a great volume of the external additive is added into the supplying means for the toner, the toner deposition amount can be adjusted in such a fashion that the toner deposition amount is increased in the toner image on the upstream side.

An advantage of the present invention is that a final toner deposition amount on the image transfer medium is maintained to a degree sufficient to express an appropriate image density for each of color toners, thereby inhibiting an influence caused by the reverse transfer of the toner, therefore providing the image forming apparatus capable of forming good images with image density being constant and proper color balance.

Another advantage of the present invention is that an increase in the toner deposition amount required for each toner can be attained by the simple construction in which a great volume of the external additive is added with the toner supplying means on the upstream side. Use of such a construction enables a conventional image forming apparatus to be manufactured with elimination of problems caused by the reverse transfer phenomenon. To be specific, the problems concerning the reverse transfer phenomenon can be resolved without increasing manufacturing cost.

BRIEF DESCRIPTION OF THE DRAWINGS

Other objects, features and advantages of the present invention will become more apparent from the following detailed description when read in conjunction with the accompanying drawings, in which.

FIG . 4 illustrates a view showing a relationship between addition amount of the external additive and the toner deposition amount on the paper with respect to black toner.

DESCRIPTION OF THE PREFERRED EMBODIMENTS

The present invention will be explained in more detailed with reference to the accompanying drawings. A description will be given of the technical background leading to the present invention which was completed by the present inventors and a fundamental principle of the present invention.

Figure 1:
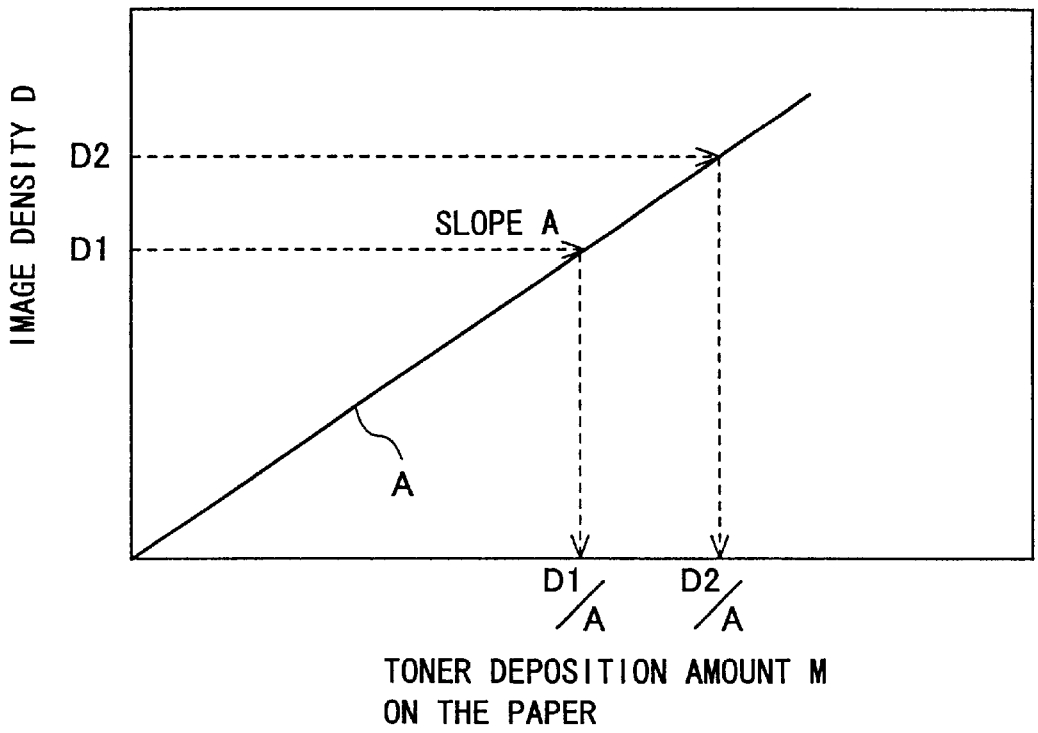
FIG. 1 shows an illustration to explain the principle according to the present invention.

Referring to FIG. 1, there is shown a relationship between the toner deposition amount on the paper (namely, the image transfer medium) and image density in the case of fixing therewith. Image density D of the color image is proportional to the toner deposition amount M on the paper. It can be confirmed that increasing the toner deposition amount results in increase of image density. That is to say, there is the following relationship:

$$D=A\times M$$

wherein M represents the toner deposition amount on the paper, D denotes image density and A represents image density per unit toner deposition amount, namely, corresponds to D/M which is a constant for each toner.

From the above relationship, in order to obtain images having an image density range falling within the range of $D1 \leqq D \leqq D2$ necessary for an appropriate image after fixation, it is necessary for the toner deposition amount M on the paper to have the range of $D1/A \leqq M \leqq D2/A$.

In general, taking a color balance between color toners into consideration, it is favorable to have the approximately same image density for each color. However, in a case of the color toner, image density per unit toner deposition amount A, which corresponds to a slope D/M in FIG. 1, typically varies with kinds of the toner. To be more specific, the range of the toner deposition amount M necessary for image having a desired image density range varies with kinds of toner. Owning to the above fact, since image density after fixation varies with the toners when the color image is formed by use of the plurality of image forming units which is controlled such that for each color, the toner deposition amount on the paper is the same each other, this results in defective color balance. Therefore, in the case of the color toner, it is required to control the toner deposition amount for each color, so as to produce a favorable color image.

For example, each image forming unit for forming each single toner image of yellow, magenta, cyan and black is arranged in the transporting direction of the paper within the color image forming apparatus based on the tandem type. Thus, each color toner is successively transferred onto the paper and then accumulated thereon to form the full color image. First of all, a yellow toner image is transferred onto the paper by means of the image forming unit for yellow. This paper is then pressed with the photoconductor of the image forming unit for magenta to form a single magenta image on the paper. Similarly, a cyan toner image and a black toner image are formed by means of the image forming units for cyan and black, respectively, so as to form the final color toner image.

In steps of forming the color toner image, new toner images are transferred and superimposed on the previous toner images by means of the downstream image forming units. To be more specific, in the case of the yellow toner image, new three toner images, namely, magenta, cyan and black toners are transferred and superimposed on the yellow toner image. Similarly, in the case of magenta toner image, new two toner images are transferred and superimposed on the magenta toner image. In addition, in the case of cyan toner image, new black toner image is transferred and superimposed on the cyan toner image. The toner image formed previously on the paper is superimposed with next color toner image while bringing the above toner image into contact with the photoconductor drum of the next transferring means in the image forming unit. The contact of the previous toner image with the photoconductor drum located on the downstream side can mainly contribute to the reverse transfer phenomenon as described above.

The present inventors have thought that adhesion force occurs under the reverse transfer phenomenon by bringing the toner image formed on the upstream side into mechanical contact with the photoconductor drum located on the downstream side, so that the above toner image can be reversely transferred to the photoconductor drum, contrary to an electric force between the toner particle and the paper.

The present inventors have studied the reverse transfer phenomenon extensively, and have confirmed that the decrease in the toner deposition amount, that is to say, a toner reverse transfer amount, caused by the reverse transfer phenomenon becomes the approximately constant for each color under the conditions of the same mechanical contact. The present inventors have confirmed that the toner reverse transfer amount caused by contact with the photoconductor drum one time becomes the approximately constant, when the toner deposition amount on the paper is much larger than that for inherent use in image formation, for example 1.3 $mg/cm^2$.

Therefore, if the toner reverse transfer amount (hereinafter referred to as OV) is a constant value each time transfer is carried out, the toner deposition amount on the paper for each color is given by sum of the toner deposition amount defined by the optimal image density for each color and the toner reverse transfer amount. Further, from the number of subjecting the toner image to the reverse transfer, namely, the number of the transferring means on the downstream side, which is expressed by TN, a total toner reverse transfer amount is given by product OV·TN. It should be noted that in the case of the image forming unit, the above number is the number of the means for transferring the toner contained in the image forming unit.

More specifically, in the case of the yellow toner image, since the yellow toner image formed on the upstream side is subjected to the reverse transfer three times by means of the transferring means at three points of the downstream side, the product of OV·TN is given by 3OV. Similarly, in the case of magenta toner image, since the number of subjecting to the reverse transfer is two, the product of OV·TN is given by 2OV. In the case of cyan toner image, since the number of subjecting to the reverse transfer is one, the product of OV·TN is given by 1OV. It should be noted that since the image forming unit for black is located on the most downstream side, no consideration can be taken for the toner reverse transfer amount.

Figure 2:
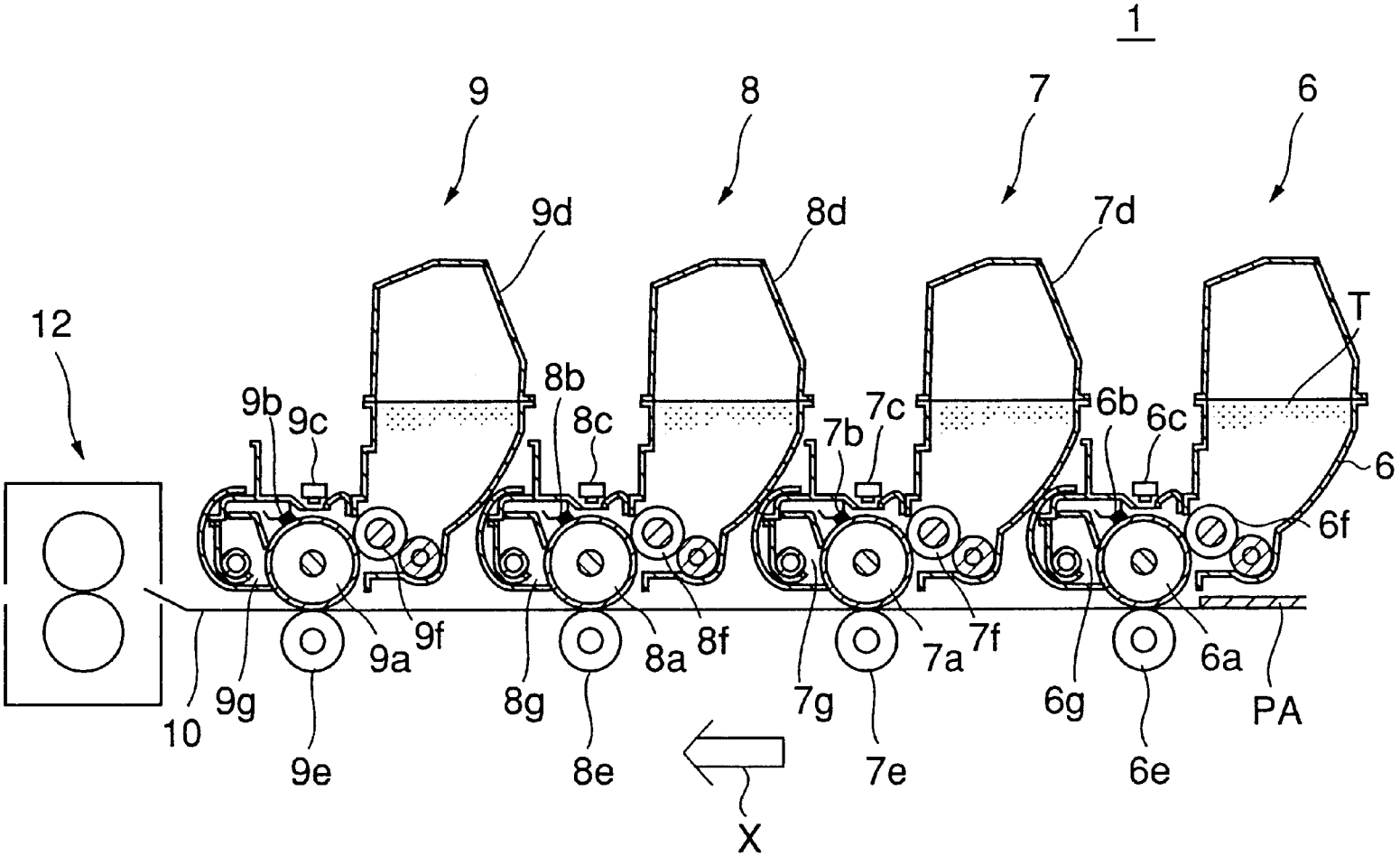
FIG. 2 shows a schematic view of the color image forming apparatus which is applicable to the present invention and which is a tandem type based on electrophotography.

The color image forming apparatus according to the present invention is constructed on the basis of the principle as described above. FIG. 2 shows a schematic view of the color image forming apparatus which is applicable to the present invention and which is a tandem type based on electrophotography. From the upstream side, the image forming units 6, 7, 8 and 9 for forming each toner image, yellow, magenta, cyan and black is arranged along an arrow X shown in FIG. 2, in the transporting direction of the paper, namely, in a direction where a visible image is successively formed. These image forming units 6, 7, 8 and 9 comprise the photoconductor drums 6*a*, 7*a*, 8*a* and 9*a* as a center, charging bodies 6*b*, 7*b*, 8*b* and 9*b* for applying a charge on a surface of the photoconductor drums, exposing means 6*c*, 7*c*, 8*c* and 9*c* for forming a latent image, developing rolls 6*f*, 7*f*, 8*f* and 9*f* for visualizing the latent image as a visible image forming means, developing bodies 6*d*, 7*d*, 8*d* and 9*d* for storing a toner T, transferring bodies 6*e*, 7*e*, 8*e* and 9*e* as the image transferring means for transfer into paper PA as the image transfer medium and cleaning means 6*g*, 7*g*, 8*g* and 9*g* for removing a remaining toner on the photoconductor drum after transfer. The image forming apparatus further comprises a transfer belt 10 which is made of dielectric belt being semi-conductive, and fixing body 10. This body 10 enables the toner image on the paper PA to be melted and pressed so as to form the color image.

Although the color image forming apparatus based on the tandem type includes the same mechanical and fundamental construction as the conventional apparatus, a state of the toner image right after transferring onto the paper PA in each image forming unit 6, 7 and 8 according to the present invention is significantly different from that of the conventional toner image. That is, the toner image according to the present invention has the toner deposition amount including an incremental amount, such as 3OV, 2OV, and 1OV in consideration of the toner reverse amount as described above.

By controlling the toner deposition amount on the paper such that each image forming unit 6, 7, 8, and 9 provides different toner deposition amount on the paper, respectively, the problems of complexity and manufacturing cost may occur in the image forming apparatus. However, the color image forming apparatus 1 according to the present invention has each of the same structural image forming unit 6, 7, 8 and 9. It is possible to change the toner deposition amount on the paper by making improvement for the toner itself contained in the developing body of each unit 6, 7, and 8.

To be more specific, a toner mobility is enhanced from the developing roller by adjusting addition amount of the external additive into each of the toner, so that the toner deposition amount can be increased on the photoconductor drum in which the toner image is firstly formed thereon. Thereafter, the toner image thus formed is further transferred onto the paper so as to form the toner image having the increased deposition amount thereon. As described later, the toner deposition amount can be changed by adjusting the amount of the external additive used for the toner.

Accordingly, fundamental elements for the toner used in the present invention have the same components as the conventional toner, and the elements include a binder resin, a coloring agent, an external additive, charge controlling agent, a parting agent or the like. However, the toner used in the present invention has a larger amount of the external additive than that of the conventional toner except for the toner used on the most downstream side. Therefore, the toner used on the most upstream side is set to have the largest amount of the external additive.

It should be noted that as external additives, use may be made of the general inorganic particulates known in the art. For example, a primary particle size of the inorganic particulate is preferably between 5 $\mu$m and 2 $\mu$m, more preferably between 5 $\mu$m and 500 $\mu$m. A specific surface area of the inorganic particulate is preferably between 20 and 500 $m^2/g$, as estimated by a BET method. Examples of such inorganic particulates include silica, alumina, titanium oxide, barium titanate, magnesium titanate, calcium titanate, strontium titanate, zinc oxide, tin oxide, silica sand, clay, mica, silica stone, diatom earth, chromium oxide, cerium oxide, red iron oxide, antimony trioxide, magnesium oxide, zirconium oxide, barium sulfate, barium carbonate, calcium carbonate, silicon carbide, silicon nitride or the like. Examples of the inorganic particulates further include a polymer particle, such as polystyrene and copolymer of methacrylic ester and acrylic ester synthesized by soap-free emulsion polymerization, suspension polymerization or dispersion polymerization, and silicone, benzoguanamine and nylon prepared by polycondensation or the like.

However, the external additive used in the present invention preferably has the function of increasing the toner deposition amount onto the photoconductor drum, in addition to the conventional charge contorolling and fluidity controlling properties. It is preferable for the external additive to have the controlling capability of the toner deposition amount without changing the fluidity undesirably. Use may preferably be made of hydrophobic silica. Examples of the hydrophobic silica include RY50 (manufactured by Nippon Aerosil Co. Ltd.), NY50 (manufactured by Nippon Aerosil Co. Ltd.), NA50H (manufactured by Nippon Aerosil Co. Ltd.), TTO-55 (manufactured by Ishihara Industry Co. Ltd.), ET-300W (manufactured by Ishihara Industry Co. Ltd.), SN-100P (manufactured by Ishihara Industry Co. Ltd.), STT-30A (manufactured by Titan Industrial Co. Ltd.), STT65C-S (manufactured by Titan Industrial Co. Ltd.), EC-300 (manufactured by Titan Industrial Co. Ltd.), ZnO-310 (Si) (manufactured by Sumitomo Osaka Cement Co. Ltd.) or the like.

The external additive used in the present invention may be used in combination of other external additive which impart high fluidity to the toner. Examples of such other external additive include R972D (manufactured by Nippon Aerosil Co. Ltd.), R974 (manufactured by Nippon Aerosil Co. Ltd.), R976 (manufactured by Nippon Aerosil Co. Ltd.), RY200 (manufactured by Nippon Aerosil Co. Ltd.), RY200S (manufactured by Nippon Aerosil Co. Ltd.), RX200 (manufactured by Nippon Aerosil Co. Ltd.), RX300 (manufactured by Nippon Aerosil Co. Ltd.), TG810G (CABOT Co. Ltd.), TG811F (CABOT Co. Ltd.), TS-530 (CABOT Co. Ltd.) or the like. In this case, the toner deposition amount can be changed by varying the fluidity of the toner by adding the external additive which has the property of increasing the deposition amount, with a constant amount of the external additive being added which imparts the high fluidity.

Further, the following will be a description of other component for the toner usable for the present invention. Examples of binder resins include polymers of styrene and derivatives thereof, such as polystyrene, poly-p-chlorostyrene, polyvinyltoluene, copolymers based on styrene types, such as copolymer of styrene and p-chlorostyrene, copolymer of styrene and propylene, copolymer of styrene and vinyltoluene, copolymer of styrene and vinylnaphthalene, copolymer of styrene and methyl acrylate, copolymer of styrene and ethyl acrylate, copolymer of styrene and butyl acrylate, copolymer of styrene and octyl acrylate, copolymer of styrene and methyl methacrylate, copolymer of styrene and ethyl methacrylate, copolymer of styrene and butyl methacrylate, copolymer of styrene and methyl $\alpha$-chloromethacrylate, copolymer of styrene and acrylonitrile, copolymer of styrene and vinyl methyl ketone, copolymer of styrene, acrylonitrile and isobutene, copolymer of styrene and maleic acid, copolymer of styrene and maleic ester or the like, polymethyl methacrylate, polybutyl methacrylate, polyvinyl chloride, polyvinyl acetate, polyethylene, polypropylene, polyester, an epoxy resin, an epoxy polyol resin, polyurethane, polyamide, polyvinyl butyral, a polyacrylic resin, rosin, modified rosin, a terpene resin, an aliphatic or alicyclic hydrocarbon resin, an aromatic petroleum resin, chlorinated paraffin, paraffin wax and the like. The binder resins may be used alone or in combination.

It is also possible to use any type of dye or pigment known in the art as the coloring agent.

Example of such coloring agents include carbon black, nigrosine dye, iron dye, naphtol yellow S, pigment yellow (10G, 5G, G), cadmium yellow, yellow iron oxide, loess, chrome yellow, titan yellow, polyazo yellow, oil yellow, pigment yellow (GR, A, RN, R), pigment yellow L, benzidine yellow (G, GR), permanent yellow (NCG), vulcan fast yellow (5G, R), tartrazine lake, quinoline yellow lake, anthracene yellow BGL, isoindolinone yellow, red iron oxide, lead red, cadmium red, cadmium mercury red, antimony red, permanent red 4R, para red, parachloro nitroaniline red, fast scarlet G, brilliant fast scarlet, brilliant carmine BS, permanent red (F2R, F4R, FRL, FRLL, F4RH), fast scarlet VD, fast rubine B, brilliant scarlet G, lithol rubin GX, permanent red F5R, brilliant carmine 6B, pigment scarlet 3B, bordeaux 5B, toluidine maroon, permanent bordeaux F2K, heliobordeaux BL, bordeaux 10B, bonmaroon light, bon maroon medium, eosine lake, Rhodamine lake B, Rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanine blue, phthalocyanine blue, fast sky blue, indanthrene blue (RS, BC), indigo, ultramarine, prussian blue, anthraquinone blue, fast violet B, methyl violet lake, cobalt violet, manganese violet, dioxane violet, anthraquinone violet, chrome green, zinc green, chromium oxide, bilicyanin, emerald green, pigment green B, naphtol green B, green gold, acid green lake, malachite green lake, phthalocyanine green, anthraquinone green, titanium oxide, zinc white, lithopone and mixtures thereof. As with the conventional usage, a content of the coloring agent is between 0.1 and 50 parts by weight relative to 100 parts by weight of the binder resin.

If necessary, it is possible to use the charge controlling agent for the toner used in the present invention. The charge controlling agent may be any type of the charge controlling agent known in the art. Examples of the charge controlling agent include nigrosine-based dye, triphenylmethane-based dye, chrome-containing metal complex dye, molybdate chelate pigment, Rhodamine-based dye, alkoxyl-based amine, quaternary ammonium salt (containing fluorine-modified quaternary ammonium salt), alkylamide, phosphorus as single substance or compound, tungsten as single substance or compound, fluorine-containing surfactant, metal salicylate and derivatives thereof. More specifically, use may be made of bontron 03 as the nigrosine-based dye, bontron P-51 as the quaternary ammonium salt, bontron S-34 as a metal-containing azo dye, E-82 as a oxynaphthoic acid-based metal complex, E-84 as a salicylic acid-based metal complex, E-89 as a phenol-based condensation (the above compounds are made by Orient Chemical Co. Ltd.), TP-302 and TP-415 (manufactured by Hodogaya Chemical Industry Co. Ltd.) as an quaternary ammonium molybdenum complex, copy charge PSY VP2038 as the quaternary ammonium salt, copy blue PR as a triphenylmethane derivative, copy charge NEG VP2036 and copy charge NX VP434 as the quaternary ammonium salt (the above compounds are made by Hoechst Co.), LR-147 (manufactured by Nippon Carlit Co. Ltd.), copper phthalocyanine, perylene, quinacridone, azo-based pigment and a polymeric compound having the functional groups such as sulfonic acid, carboxylic acid, quaternary ammonium salt or the like.

Since a use amount of the charge controlling agent is dependent upon kinds of the binder resins, if necessary, presence of the additive and a toner manufacturing method including dispersion method, the use amount is not particularly limited. It is preferable that the use amount of the charge controlling agent is between 0.1 and 10 parts by weight relative to 100 parts by weight, more preferably between 2 and 5 parts by weight.

For the purpose of imparting the releasability to the toner used in the present invention, it is possible to use a wax. It is preferable that the wax used for the toner has the melting point of from 40 to 120° C., more preferably from 50 to 110° C. If the melting point of the wax is more than a desired temperature, fixing performance of the toner is likely to be insufficient at the low temperature of fixing. On the other hand, if the melting point thereof is less than the desired temperature, there may be possibility of less offset resistance and less durability. It should be noted that the melting point of the wax is determined by means of a differential scanning calorimetry method. That is, the melting point can be defined by a melt peak value when measuring at a constant heating rate of a few mg of a sample, for example 10° C./min.

Examples of the waxes used for the toner of the present invention include a solid paraffin wax, microwax, ricewax, aliphatic amide-based wax, aliphatic wax, aliphatic monoketones, aliphatic acid metal salt wax, aliphatic acid ester-based wax, partial saponified aliphatic acid ester-based wax, silicone varnish, fatty alcohol, carnauba wax or the like. Use may also be made of low molecular weight polyolefins such as polyethylene and polypropylene and the like. It is preferable that the wax has the melting point of from 70 to 150° C., more preferably from 120 to 150° C., as measured by means of an environmental method.

Now, a description will be given of an embodiment of the present invention. In this embodiment, for more understanding of the present invention, the description of the embodiment begins with the preparation of a non-magnetic toner as one example. Thereafter, the description will follow with confirmations of a desired toner deposition for each of color toner in order to obtain an appropriate image density, and of the toner reverse transfer amount, determination of the addition amount for the external additive, and confirmation test of the color image forming apparatus provided with the toner manufactured according to the present invention. It should be noted that the present invention is not limited to the following working examples only. Throughout the following description, the term "parts" represents parts by weight on a weight basis, unless otherwise specified.

| [Toner Preparation] | |
|---|---|
| 1) Common material for each color (yellow, magenta, cyan and black) | |
| Resin A: polyester resin<br>Mn = 2900, Mw = 15000, Mw/Mn = 5.2 | 100 parts |
| Charge controlling agent: zinc salicylate derivative | 4 parts |
| 2) Material for each color | |
| Black | |
| Resin B: styrene-acrylic-based resin<br>MI value: 5 | 5 parts |
| Coloring agent: carbon black | 5 parts |
| Yellow | |
| Coloring agent: disazo-based yellow pigment<br>(C.I. Pigment Yellow 17) | 5 parts |
| Cyan | |
| Coloring agent: copper phthalocyanine blue pigment<br>(C.I. Pigment Blue 15) | 5 parts |
| Magenta | |
| Coloring agent: C.I. Pigment Red 184 | 5 parts |

For each color toner, the coloring agent was prepared to have the same amount therein.

For each color toner, the above components were melted and kneaded by means of a roll mill and were then cooled. Thereafter, the mixture was coarsely pulverized by a hammer mill and was finely pulverized by means of a jet mill to yield a fine particle. The fine particle was classified to have a particle size of about 90 $\mu$m. Then, the fine particle was mixed with 1.5 parts of RY 50 (hydrophobic silica manufactured by Nippon Aerosil Co. Ltd.) and 0.1 parts of R972D (hydrophobic silica manufactured by Nippon Aerosil Co. Ltd.) by means of a high speed rotation mixer, treatment of which is called an external treatment, thus providing each color toner.

[Confirmation of the Toner Deposition Amount to Obtain the Appropriate Image Density]

An image forming test was conducted by mounting the four color toners prepared above on the color image forming apparatus based on the tandem type shown in FIG. 2 and it was confirmed that there was a relationship between the image density and the toner deposition amount on the paper. In this test, a developing bias was changed which was applied to each developing roller 6*a*, 7*a*, 8*a* and 9*a* of the respective colors, so that the toner deposition amount could be varied on the paper. Thereafter, this toner image was fixed to measure the image density.

Figure 3:
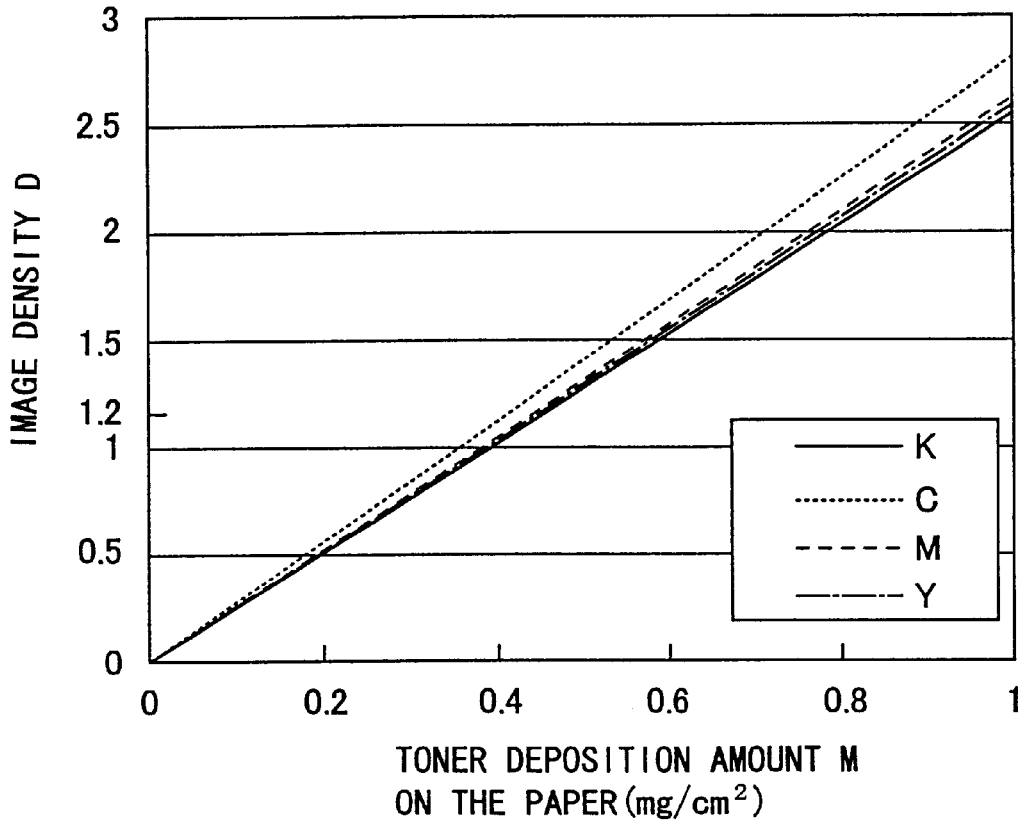
FIG. 3 illustrates a view showing a relationship between image density and the toner deposition amount on the paper of yellow(Y), magenta(M), cyan(C) and black(K)

FIG. 3 shows results of the relationship between the image density and the toner deposition amount on the paper for each color. In this figure, Y represents yellow color, M does magenta, C does cyan and K does black. Incidentally, the measurement of the image density was performed by means of Spectral Densitometer 938 manufactured by X-Rite Inc. As can be seen from FIG. 3, the image densities per the deposition amount A, that is, the slope OD/M, were determined to be 2.58, 2.61, 2.80 and 2.54 for yellow, magenta, cyan and black, respectively, wherein D represents the image density and M represents the toner deposition amount on the paper in mg/cm$^2$.

From these results, in order to obtain the image density of from 1.2 to 2.5, a range of which is generally regarded as being suitable, the present inventors found that it is preferred that with respect to the toner deposition amount on the paper in mg/cm$^2$ for each color, yellow is in the range of from 0.47 to 0.97, magenta is in the range of from 0.46 to 0.96, cyan is in the range of from 0.43 to 0.89 and black is in the range of from 0.47 to 0,98.

[Confirmation of the Reverse Transfer Amount Due to the Reverse Transfer]

Next, the reverse transfer amount was examined because of the reverse transfer. Shown in FIG. 1 is the color image forming apparatus comprising yellow, magenta, cyan and black color image forming parts which are successively arranged therein. With respect to yellow color, the yellow color toner is subjected to the reverse transfer three times. With respect to magenta color, the magenta color toner is subjected to the reverse transfer two times. With respect to cyan color, the cyan color toner is subjected to the reverse transfer one time. It should be noted that the order of each color in the apparatus is not necessarily fixed, and the order may be exchanged each other.

With respect to the toner image, the toner amount deprived by the reverse transfer can be considered to be the same amount as the difference of the toner amount between on the photoconductor drum before transfer and on the paper formed finally. In the color image forming apparatus 1, the order of the toner reverse transfer amount is as follows: yellow>magenta>cyan. No the reverse transfer takes place in the case of black.

The toner reverse transfer amount (OV) one time was found to be about 0.1 mg/cm$^2$ in the color image forming apparatus 1. Since this amount (OV) is dependent upon the transfer conditions, such as a transfer pressure, this amount is not fixed value. Therefore, the value of about 0.1 mg/cm$^2$ was determined by a given transfer condition in the color image forming apparatus. It should be noted that it is again necessary to confirm the OV value when the transfer conditions may be changed even in the same color forming apparatus.

On the basis of the OV value, the conditions of the toner deposition amount was established in order to obtain the same image density with respect to the four color images. Using the toner deposition amount suitable for the appropriate image density obtained from the results of FIG. 3, namely, the toner deposition amount of from 0.47 to 0.97 in the case of yellow, the toner amount of from 0.46 to 0.96 in the case of magenta and the toner amount from 0.43 to 0.89 in the case of cyan, a total toner reverse transfer amount was determined by the following formula:

$$OV\ (=0.1\ mg/cm^2)\times TN$$

wherein TN represents the number of the transfer means.

With consideration of the toner reverse transfer amount and the assumption that a transfer efficiency is 100 percentage, a suitable toner deposition amount on the paper is in a range of from 0.07 to 1.27 mg/cm$^2$ for the yellow toner, from of 0.66 to 1.16 mg/cm$^2$ for the magenta toner, from 0.53 to 0.99 mg/cm$^2$ for the cyan toner and from 0.47 to 0.98 mg/cm$^2$ for the black toner. Accordingly, the above range of the toner deposition amount enables the image density to be established acceptably, thereby providing the approximately same image density for each color.

[Confirmation of Addition Amount of the External Additive]

A description will be given of the formulation of the external additive, for the purpose of obtaining the toner imparting the toner deposition amount with respect to each color toner as described above.

The procedure for the above toner preparation was repeated except that the external additive was added. In this preparation of the toner with the external additive, for example, by use of 0.2 parts of R972D (hydrophobic silica manufactured by Nippon Aerosil Co. Ltd.), the influence of the addition amount of the external additive was examined by adjusting the amount of RY50 (the hydrophobic silica manufactured by Nippon Aerosil Co. Ltd.) having the larger amount than that of R972D.

Figure 4:
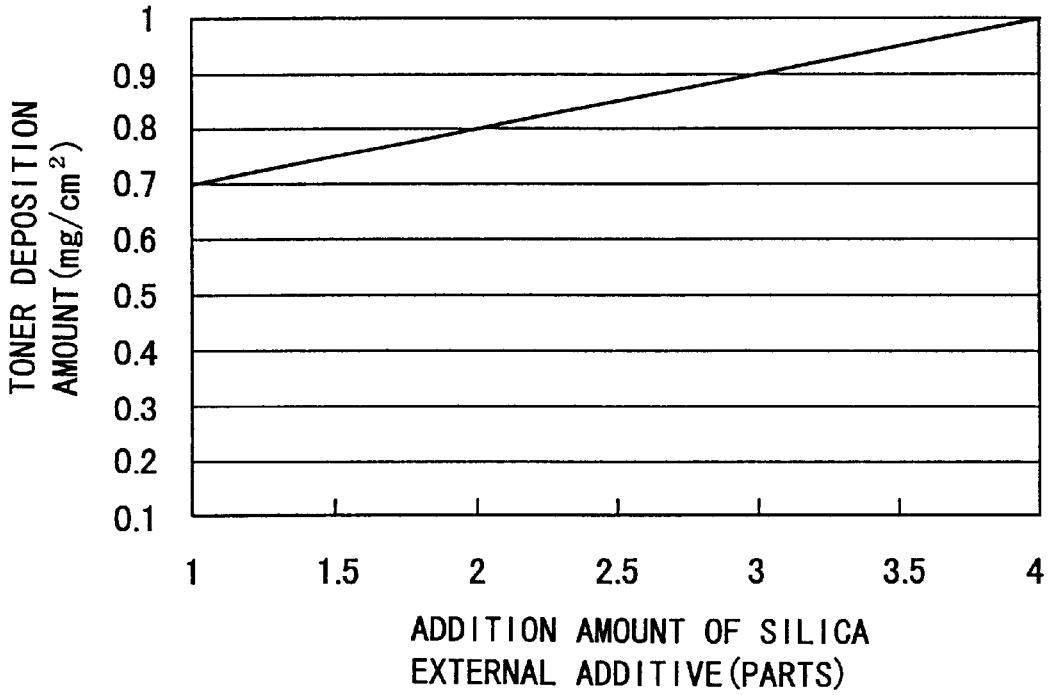

Experiments of the influence of the external additive on the toner was conducted by means of the black toner, because the black toner is not subjected to the reverse transfer. FIG. 4 shows results of the relationship between the addition amount of the external additive and the toner deposition amount on the paper. It should be noted that the toner deposition amount on the paper is identical to that on the photoconductor drum.

From the results of FIG. 4, it was confirmed that there was a tendency of increasing the toner deposition amount on the paper, as the addition amount of the external additive was increased, to be specific, as the addition amount of the hydrophobic silica RY50 became large. It should be noted that the toner fluidity because of increasing the addition amount varies with kinds of the external additive. In the above example, use was made of 0.2 parts of R972D for imparting the ability of enhancing fluidity of the toner and the suitable fluidity and toner deposition amount can be ensured in combination with the addition of 0.5 to 4.0 parts of RY50. The large use of the external additive which imparts the function of increasing the toner deposition amount enables the toner deposition amount to be increased without the undesired change of the fluidity. It should be noted that the external additive used in the present invention may be any type of the general inorganic fine particle as mentioned above. However, it is recommended that use is made of the silica particle which is subjected to the hydrophobic treatment.

The procedure for the black toner preparation with the external additive is applicable to other yellow, magenta and cyan toners. For example, if the target conditions for the appropriate image density of the four colors is to have the image density of 1.8 on the paper, the toner deposition amount on the paper in mg/cm$^2$ for yellow, magenta, cyan and black is 0.699, 0.689,0.645 and 0.697, respectively, on the based of the results of FIG. 3. When taking the reverse transfer into consideration, the toner deposition amount on the photoconductor drum for each color is 0.999 for yellow, 0.889 for magenta, 0.745 for cyan and 0.697 for black. Hence the addition amount of the external additive for each color was determined to be 3.9 parts, 2.8 parts, 1.4 parts and 0.9 parts for yellow, magenta, cyan and black, respectively.

Needless to say, the value 1.8 of the image density is illustrative one. Therefore, a necessary amount of the external additive can be determined from the results of FIG. 4 with respect to the appropriate image density having the generally acceptable range of from 1.2 to 2.5.

[Test for Image Formation by Means of the Image Forming Apparatus]

Each color toner was prepared under the conditions that the target value of the image density was 1.8, as stated above. These colors toner was mounted on the color image forming apparatus 1 based on the tandem type as shown in FIG. 1 and the full color image formation was carried out therewith. The image density thus formed was measured in the similar manner as the above.

The results is given below in Table 1. As can be seen from Table 1, the image density of each color could be adjusted to have the approximately same, so that good color balance of the toner image could be attained with a vivid color.

TABLE 1

| | Toner according to the present invention | Conventional toner |
|---|---|---|
| Yellow | 1.80 | 1.17 |
| Magenta | 1.78 | 1.44 |
| Cyan | 1.78 | 1.82 |
| Black | 1.78 | 1.91 |

The target of the image density was 1.8.

For the sake of comparison, Table 1 lists the results of the conventional toner under the same conditions as the toner according to the present invention. In this case of the conventional toner, it was confirmed that the image density was decreased on the upstream side due to the influence of the reverse transfer phenomenon. On this account, the conventional toner provides poor color balance of the toner image in the image forming apparatus used in the present invention.

As can be evident from the foregoing, in the present invention the addition amount of the external additive can be easily changed in the order of yellow>magenta>cyan>black within the color image forming apparatus 1, so that an excellent color image can be obtained. This enables the toner deposition amount on the paper to be controlled to meet the predetermined conditions, thus eliminating the influence of the reverse transfer and hence the good toner image was obtained with the approximately same density for each color.

It should be noted that it is ideal that each color of the image has one and the same density, but it is acceptable that the difference of image density between the four colors is equal to or less than 0.5 because of little or no influence on image formation.

Further, although the above color image forming apparatus 1 is the tandem type, the present invention is not limited thereto. The toner according to the present invention is applicable to the image forming apparatus in which the toner image formed on the image transfer medium is reverse-transferred on the downstream side in next transfer step.

Figure 5:
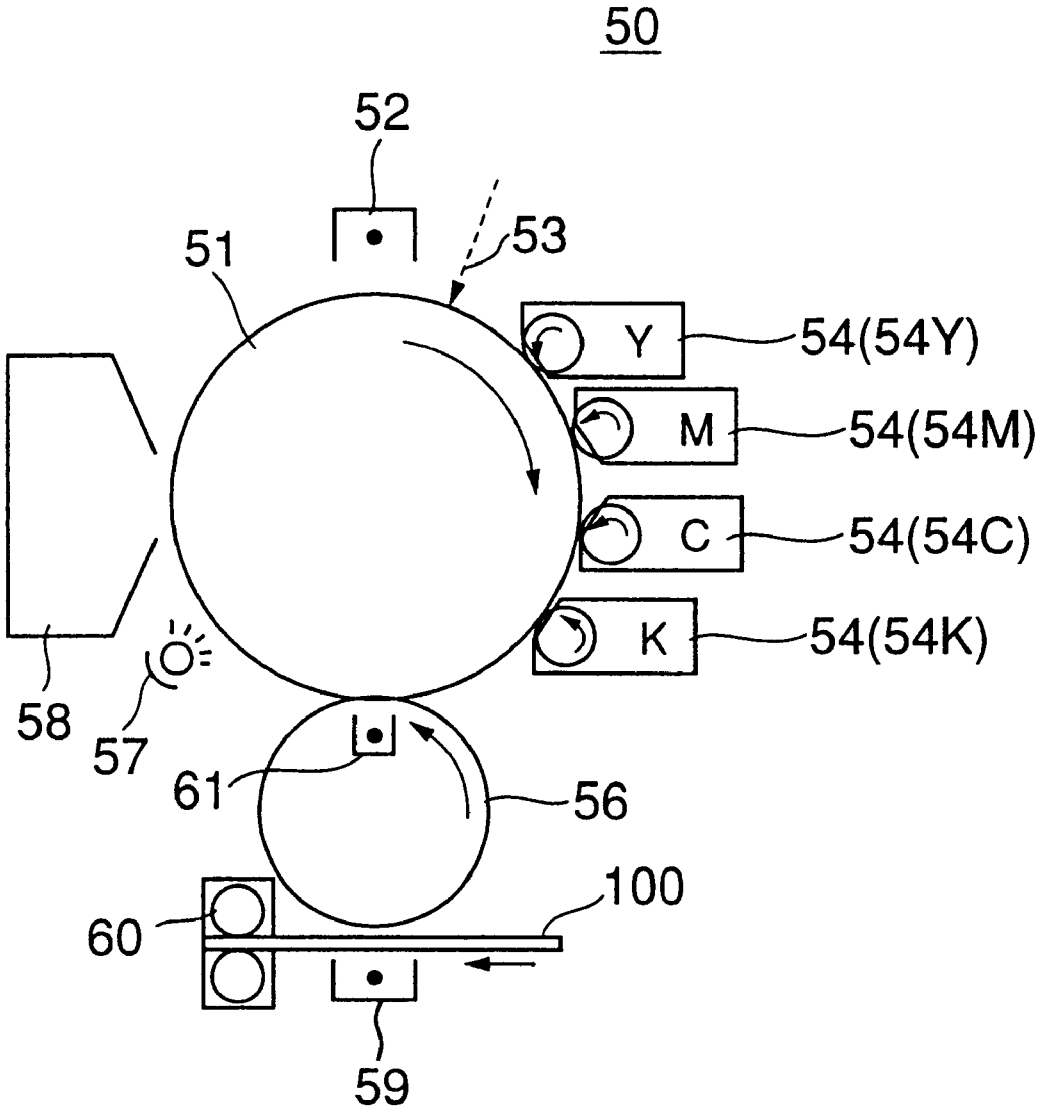
FIG. 5 illustrates a view showing an outline construction of the color image forming apparatus which is applicable to the present invention and which is a single drum type.

FIG. 5 illustrates a view showing an outline construction of the color image forming apparatus 50 which is the single drum type and which is capable of forming the color image with the intermediate transfer medium.

Within the color image forming apparatus, the single toner image is accumulated four times to form the full color image. The color image forming apparatus 50 comprises a photoconductor drum 51 which is driven to move, the charging body 52 for charging a surface of the photoconductor drum 51, the charging body being arranged around the drum, a exposing part 53 for exposing the surface of the photoconductor drum 51 to form a latent image and four developing bodies 54 (54Y, 54M, 54C and 54K) for developing the latent image with toners of yellow (Y), magenta (M), cyan (C) and black (K) to form a toner image. The apparatus 50 also comprises an intermediate transfer drum 56 for receiving the toner image formed on the drum 51. The intermediate transfer drum 56 comprises as a transfer means a transfer body 61 which is arranged therein.

The apparatus 50 further comprises discharging body 57 for discharging the surface of the photoconductor drum 51, a cleaner 58 for removing a toner remaining on the surface of the drum 51, a transfer body 59 for transferring the toner image on the transfer drum 61 onto a paper 100 and a fixing body 60.

In the above apparatus 50, the single toner image is formed four times on the photoconductor drum 51 by means of the four developing bodies 54 (54Y, 54M, 54C ad 54K). Each time the toner image was formed on the drum 51, the transfer body 61 is driven to transfer the toner image onto the transfer drum 56. Each toner image is accumulated on the drum 56 to form the full color image thereon. Thereafter, the above full color toner image is transferred onto the paper 100. In this way, since the transfer drum 56 is brought into contact with the photoconductor drum 51 four times while carrying the toner image, the reverse transfer phenomenon as mentioned above occurs with respect to the toner image formed previously on the transfer drum 56.

In the case of image forming apparatus 50, the transfer drum 56 corresponds to the image transfer medium and the photoconductor drum 51 and the transfer body 61 serve as the image forming medium the toner image is transferred four times. In this point, there is possibilities that the previous toner image may be reverse-transferred in next transfer step of the subsequent toner image.

Therefore, as with the foregoing explanation, by adjusting the developing body 54 on the upstream side such that the larger amount of the external additive is contained therein, the image density for each color can be adjusted so as to provide the image formation with the good color balance and the vivid color.

The present invention is not limited to the specifically disclosed embodiments, and variations and modifications may be made without departing from the scope of the present invention.

The present invention is based on Japanese priority application No. 2000-205281 filed on Jul. 6, 2000, the entire contents of which are hereby incorporated by reference.

What is claimed is:

1. A color image forming apparatus which forms a color image by superimposing images of respective colors one over another, comprising:

a plurality of forming units which form toner images of respective colors on respective image forming mediums; and a plurality of transfer units which successively transfer the toner images from the image forming mediums onto an image transfer medium by bringing the toner images of the image forming mediums in contact with the image transfer medium, wherein a toner deposition amount deposited on the image transfer medium by a given one of said transfer units upon said contact is adjusted to contain an incremental amount over a color-specific final toner amount that should remain after completion of transfer of all the toner images, said incremental amount being adjusted to be greater for a toner image of a given transfer than a image of a subsequent transfer by adjusting an amount of an external additive added to toner.

2. A color image forming apparatus in which a color image is formed by accumulating a visible image on an image transfer medium, said color forming apparatus comprising:

a plurality of forming means for forming the visible image on an image forming medium with a toner; and a plurality of transferring means for transferring the visible image onto the image transfer medium while bringing the visible image into contact with the image transfer medium, wherein with respect to a toner amount which is transferred from each of the image forming means onto the image transfer medium, a difference between a toner deposition amount on the image transfer medium right after transferring the visible image from the image forming medium and a final toner deposition amount on the image transfer medium in the event of transfer of visible images is completed onto the image transfer medium is set such that the difference of the toner deposition amount of the visible image which is transferred by the transferring means disposed on an upstream side is larger than that on a downstream side in a direction where the visible image is successively formed;

wherein the toner deposition amount which is transferred onto the image transfer medium by means of the transferring means disposed on the upstream side contains an incremental amount in consideration of a reverse transfer according to the number of the transferring means disposed on the downstream side as compared to that on the upstream side.

3. The color image forming apparatus as claimed in claim 2, wherein when a reverse transfer toner deposition amount which is reverse-transferred by means of one transferring means on the downstream side is given by a constant OV and the number of the transferring means on the downstream side is given by TN, the incremental amount is defined by product OV·TN.

4. The color image forming apparatus as claimed in claim 3, wherein the incremental amount is adjusted by changing an addition amount of an external additive contained in the toner for use in each of the forming means according to the toner.

5. A color image forming apparatus provided with an unit for forming an image, in which a color image is formed by accumulating a visible image on an image transfer medium, the unit comprising:

a plurality of supplying means for supplying various types of toners;

at least one forming means for forming the visible image on an image forming medium with the toner; and transferring means for transfer the visible image onto the image transfer medium while bringing the visible image into contact with the image medium, wherein each of the toner which is stored in the respective supplying means includes an external additive and an addition amount, which is given by Sn, of the external additive contained in the respective supplying means is set such that there is a relationship of S1>S2>S3>S4 . . . >Sn, where n represents the order from an upstream side.

* * * * *